US007426932B2

(12) United States Patent
Zaccone

(10) Patent No.: US 7,426,932 B2
(45) Date of Patent: Sep. 23, 2008

(54) SPRAY FILL DEVICE AND METHOD FOR USING THE SAME

(75) Inventor: Mark Zaccone, Louisville, KY (US)

(73) Assignee: General Electric Company, Schenectady, NY (US)

( * ) Notice: Subject to any disclaimer, the term of this patent is extended or adjusted under 35 U.S.C. 154(b) by 303 days.

(21) Appl. No.: 11/233,794

(22) Filed: Sep. 23, 2005

(65) Prior Publication Data

US 2007/0067920 A1 Mar. 29, 2007

(51) Int. Cl.
*B08B 3/00* (2006.01)

(52) U.S. Cl. ..... 134/96.1; 8/158; 68/200; 68/207; 134/94.1; 134/95.3; 134/98.1; 134/99.1; 137/535; 137/540; 137/542; 137/543.19; 137/599.07; 137/602; 137/606; 239/63; 239/67; 239/68; 239/126; 239/569

(58) Field of Classification Search ..... 8/158; 68/200, 207; 134/94.1, 95.3, 96.1, 98.1, 134/99.1; 137/535, 540, 542, 543.19, 599.06, 137/599.07, 602, 606; 239/63, 67, 68, 126, 239/547, 569

See application file for complete search history.

(56) References Cited

U.S. PATENT DOCUMENTS 4,141,507 A 2/1979 Rump
4,754,622 A 7/1988 Fanson
4,809,524 A 3/1989 Sickert et al.
4,835,991 A 6/1989 Knoop et al.
5,031,426 A 7/1991 Wilson
5,167,722 A * 12/1992 Pastryk et al. ..... 134/33
5,408,716 A 4/1995 Dausch et al.
5,472,009 A * 12/1995 Linderoth ..... 137/101
5,571,259 A 11/1996 Takasu
5,669,250 A 9/1997 Dausch et al.
5,975,124 A 11/1999 Stevens, II
7,076,814 B2 7/2006 Ostrowski et al.
2004/0154094 A1* 8/2004 Ostrowski et al. ..... 4/541.1

* cited by examiner

*Primary Examiner*—Michael Barr
*Assistant Examiner*—George D Bozadjian
(74) *Attorney, Agent, or Firm*—George L. Rideout, Esq.; Armstrong Teasdale LLP

(57) ABSTRACT

A spray fill device for delivering water to a washing machine is provided. The spray fill device includes a body defining an inlet, an outlet port, a mounting port, and a plurality of outlet apertures in flow communication with the inlet. The spray fill device also includes a first valve coupled to the inlet, the valve configured to control a flow rate of water into the inlet. The spray fill device also includes a pressure relief mechanism coupled to the mounting port, the pressure relief mechanism inhibiting flow through the outlet port when a pressure within the body is less than a predetermined pressure.

18 Claims, 3 Drawing Sheets

SPRAY FILL DEVICE AND METHOD FOR USING THE SAME

BACKGROUND OF THE INVENTION

This invention relates generally to a spray fill device, and, more particularly, to a spray fill device for reducing water consumption in washing machine rinse cycles.

Washing machines typically include a cabinet that houses an outer tub for containing wash and rinse water, a perforated wash basket within the tub, and an agitator within the basket. A drive and motor assembly is mounted underneath the stationary outer tub to rotate the basket and the agitator relative to one another, and a pump assembly pumps water from the tub to a drain to execute a wash cycle.

Traditionally, rinse portions of wash cycles include a deep-fill process wherein articles in the basket are completely submerged in water and the water is agitated. As such, a large amount of water mixes with detergent remaining in the clothes after they are washed. While the concentration of detergent in the water is relatively small, a large amount of detergent can be removed from the clothes due to the large amount of water involved. It has become increasingly desirable, however, to reduce water consumption in washing operations.

At least some types of washing machines have reduced water consumption in rinsing operations by using a re-circulating rinse water flow. In this type of system, rinse water is collected in the bottom of the tub and pumped back through a plurality of spray nozzles located above the basket. The rinse water is re-circulated for a predetermined length of time before being discharged to a drain. See, for example, U.S. Pat. No. 5,167,722. While such systems are effective to reduce water consumption, they increase the costs of a washing machine by employing pumps, conduits, etc. that result in additional material and assembly costs.

BRIEF DESCRIPTION OF THE INVENTION

In one aspect, a spray fill device for delivering water to a washing machine is provided. The spray fill device includes a body defining an inlet, an outlet port, a mounting port, and a plurality of outlet apertures in flow communication with the inlet. The spray fill device also includes a first valve coupled to the inlet, the valve configured to control a flow rate of water into the inlet. The spray fill device also includes a pressure relief mechanism coupled to the mounting port, the pressure relief mechanism inhibiting flow through the outlet port when a pressure within the body is less than a predetermined pressure.

In another aspect, a washing machine is provided including a cabinet, a tub positioned within the cabinet, a basket rotatably mounted within the tub, and a spray fill device mounted within the cabinet and positioned to introduce water into the basket at a controlled flow rate. The spray fill device includes a body defining an inlet, an outlet port, a mounting port, and a plurality of outlet apertures in flow communication with the inlet. The spray fill device also includes a first valve coupled to the inlet, the valve configured to control a flow rate of water into the inlet. The spray fill device also includes a pressure relief mechanism coupled to the mounting port, the pressure relief mechanism inhibiting flow through the outlet port when a pressure within the body is less than a predetermined pressure.

In still another aspect, a method for performing a low water rinse for clothes in a washing machine is provided. The washing machine includes a tub and a basket rotatably mounted within the tub. The method includes spinning the clothes after a wash cycle, introducing a water spray into the basket through a spray fill device to saturate the clothes, controlling the flow of water through the spray fill device with at least one valve, and rotating the basket during saturation to wet the clothes. Water is supplied to the basket at a first flow rate during a wash cycle and a second rate during a rinse cycle, wherein the first rate greater than the second rate.

DETAILED DESCRIPTION OF THE INVENTION

Figure 1:
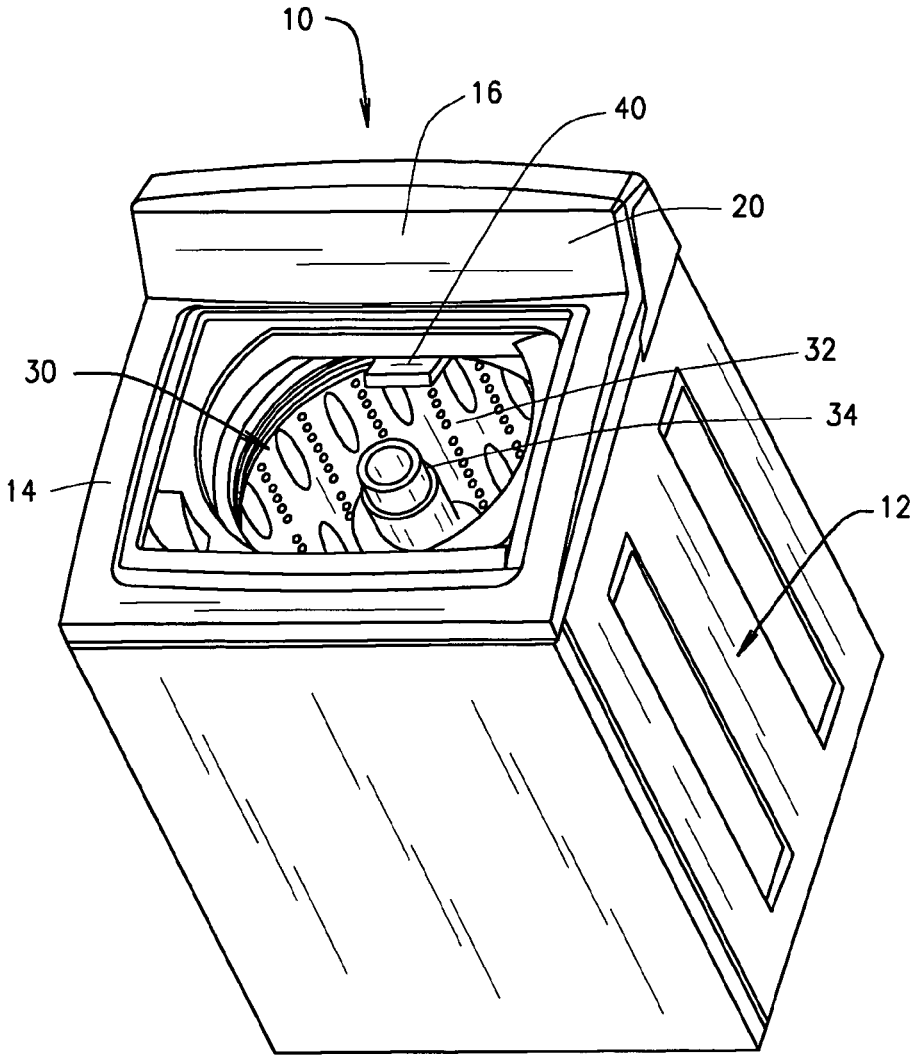
FIG. 1 is a perspective view of an exemplary washing machine.

FIG. 1 is a perspective view of an exemplary vertical axis washing machine 10 in which the invention may be practiced. It is contemplated, however, that at least some of the benefits of the present invention is applicable to other types of washing machines, such as horizontal axis washing machines. The present invention is therefore not intended to be limited to any particular type or configuration of washing machine, such as washing machine 10.

In the exemplary embodiment, washing machine 10 includes a cabinet 12 and a cover 14. A backsplash 16 extends from cover 14, and a variety of appliance control input selectors 20 are coupled to backsplash 16. Input selectors 20 form a user interface input for operator selection of machine cycles and features. A wash tub 30 is located within cabinet 12, and a wash basket 32 is movably disposed and rotatably mounted in wash tub 30 in a spaced apart relationship from wash tub 30. Basket 32 includes a plurality of perforations therein to facilitate fluid communication between an interior of basket 32 and wash tub 30. A known agitator, impeller, or oscillatory basket mechanism 34 is rotatably positioned in basket 32 on a vertical axis, and imparts an oscillatory motion to articles and liquid in basket 32. A spray fill device 40 is mounted within cabinet 12 and is positioned above basket 32 for introducing water into basket 32.

Figure 2:
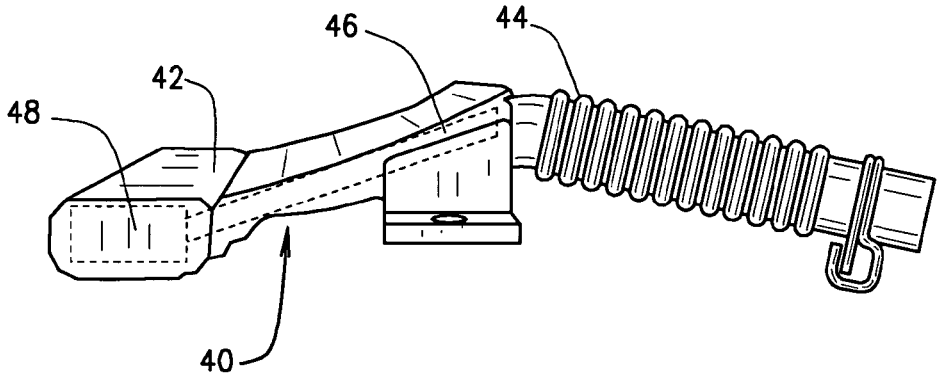
FIG. 2 is a side view of an exemplary spray fill device applicable to the washing machine shown in FIG. 1.
Figure 3:
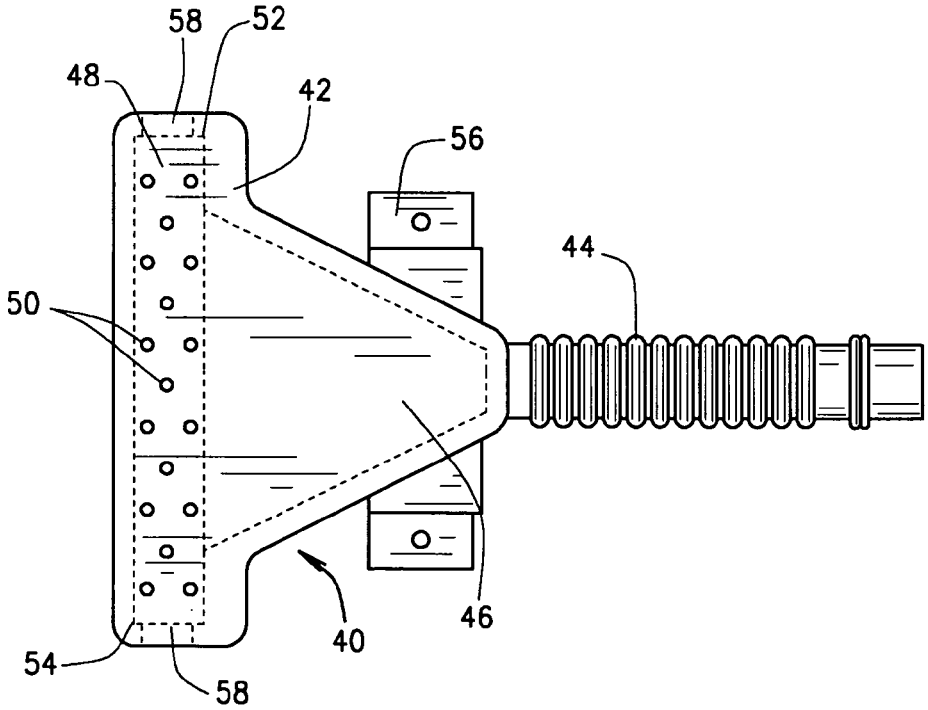
FIG. 3 is a top view of the spray fill device shown in FIG. 2.

FIG. 2 is a side view of an exemplary spray fill device 40 applicable to washing machine 10 shown in FIG. 1, and FIG. 3 is a top view of spray fill device 40 shown in FIG. 2. Spray fill device 40 includes a body 42 and a water pipe 44 coupled with body 42 for supplying water thereto.

In the exemplary embodiment, body 42 is substantially triangular in shape, and includes a water inlet 46 defined at an end thereof, an elongated channel 48 defined at another end thereof and being in flow communication with water inlet 46, and a plurality of outlet apertures 50 defined in flow communication with channel 48. Water inlet 46 is coupled in flow communication with water pipe 44 for supplying water to channel 48 therethrough. Elongated channel 48 further includes a first end 52 and a second opposite end 54, and outlet apertures 50 are arranged in rows between first and second ends 52, 54. Body 42 further includes an elongated mounting portion 56 formed thereon, which is configured to mount spray fill device 40 onto washing machine 10 (shown in FIG. 1) and above basket 32 (shown in FIG. 1). In one embodiment, outlet apertures 50 are defined on body 42 at varying angles from 60 to 90 degrees with respect to a horizontal plane when spray fill device 40 is mounted in washing machine 10. Specifically, outlet apertures 50 are defined on body 42 at varying angles from 70 to 85 degrees with respect to the horizontal plane. In another embodiment, outlet apertures 50 are defined on body 42 at a uniform angle with respect to the horizontal plane. In one embodiment, a mounting port 58 is defined at each end 52, 54 of channel 48 and is in flow communication with channel 48.

Figure 4:
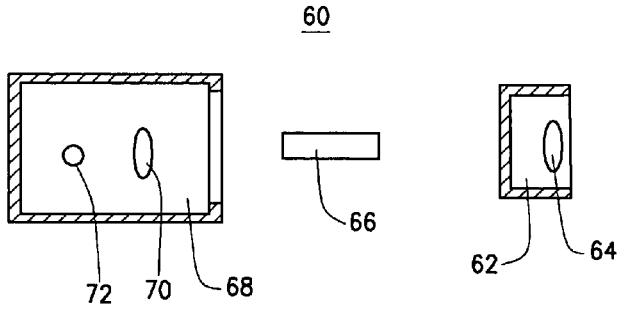
FIG. 4 is an exploded view of a pressure relief mechanism applicable to the spray fill device shown in FIG. 2.

FIG. 4 is an exploded view of a pressure relief mechanism 60 applicable to spray fill device 40 shown in FIG. 2. Pressure relief mechanism 60 includes an inner cap 62 having an inner opening 64 defined therethrough, and a biasing member or spring 66 positioned to bias inner cap 62 to a first position. Inner opening 64 of inner cap 62 is substantially oval in shape, and substantially perpendicularly extends with respect to the axis of inner cap 62. In one exemplary embodiment, spring 66 has a spring rate of 0.6 pound per inch, and has a free length of 1.5 inch. It is contemplated that inner opening 64 can be of different shapes, and biasing member 66 can be of different configurations and characteristics. Pressure relief mechanism 60 is configured to mount within mounting port 58 in channel 48.

In the exemplary embodiment, body 42 (shown in FIG. 2) further includes an outer cap 68 sized larger than inner cap 62, such that outer cap 68 receives inner cap 62 and spring 66 therein. Outer cap 68 further defines an outlet port 70 and a bleed hole 72 therethrough interiorly positioned within outer cap 68 with respect to outlet port 70. Outlet port 70 has a similar shape to inner opening 64 and is sized and positioned substantially the same as inner hole 64 of inner cap 62, such that at a particular location of inner cap 62 outlet port 70 overlaps with inner opening 64 to allow water flow therethrough. In an alternate embodiment, body 42 includes an integral member functionally equivalent to outer cap 68.

Figure 5:
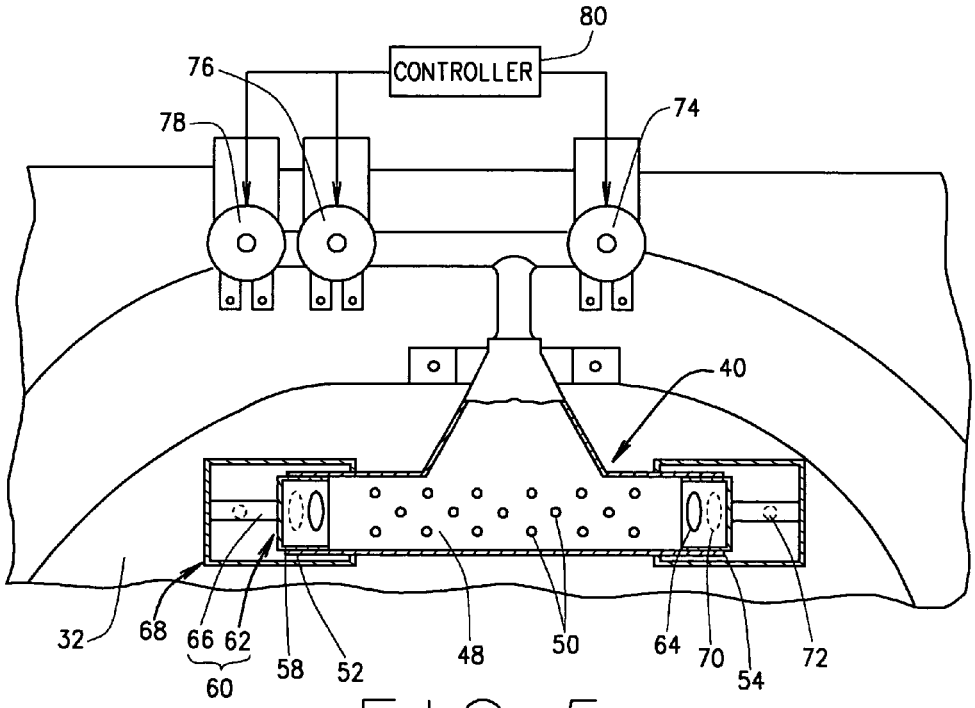
FIG. 5 is a top view of the spray fill device mounted on the washing machine shown in FIG. 1.

FIG. 5 is a top view of spray fill device 40 mounted on washing machine 10 shown in FIG. 1 with pressure relief mechanism 60 attached thereto. In the exemplary embodiment, washing machine 10 includes a first, second and third valves 74, 76, and 78 coupled in flow communication with water pipe 44 of spray fill device 40, for controlling the flow of water to spray fill device 40. Washing machine 10 also includes a controller 80 operatively coupled to valves 74, 76, and 78, and/or other washing machine components, such as basket 32, and agitator 34 (shown in FIG. 1), for controlling the operation thereof. Controller 80 may also be electrically connected with input selectors 20 (shown in FIG. 1) for receiving operator selection of machine cycles and features.

In the exemplary embodiment, pressure relief mechanism 60 is mounted on body 42, and is engaged with each mounting port 58 defined at ends 52, 54 of channel 48. Specifically, inner cap 62 is slidably received in mounting port 58 of channel 48, and is movable between a first position (shown in FIG. 5) and a second position. Outer cap 68 is positioned over mounting port 58 to cover mounting port 58, and spring 66 is positioned between inner and outer caps 62, 68 to bias inner cap 62 toward the first position. In the first position, inner opening 64 is misaligned with outlet port 70, and thus outlet port 70 is covered by inner cap 62, such that water is inhibited from flowing through outlet port 70. In the second position, inner opening 64 is aligned with and overlaps outlet port 70, such that water flow through outlet port 70 is enabled. Spring 66 retains inner cap 62 at the first positioned while the water pressure within channel 48 is below a predetermined pressure. When the water pressure within channel 48 increases to exceed the predetermined pressure, spring 66 is compressed, and inner cap 62 overcomes the resilient force of spring 66 to move from the first position to the second position. As such, pressure relief mechanism 60 inhibits flow through the corresponding outlet port 70 when water pressure within body 42 is below the predetermined pressure, and inner cap 62 allows flow through the compensating outlet port 70 is at or above the predetermined pressure.

In the exemplary embodiment, as described above, inner opening 64 and outlet port 70 are oval in shape, and extend substantially perpendicularly with respect to the moving direction of inner cap 62. As such, the exit area through which water flows may significantly change when inner cap 62 moves only a short distance. This water flow facilitates pressure relief mechanism 60 to realize the desired pressure relief relatively quickly. Bleed hole 72, defined behind inner cap 62, is kept uncovered whether inner cap 62 is in the first position or in the second position. As such, bleed hole 72 provides air flow communication between the interior and the exterior of outer cap 68, and prevents pressure from building up within outer cap 68 and behind inner cap 62, which in turn facilitates inner cap 62.

During a wash cycle, controller 80 operates a wash fill and directs a predetermined amount of water into wash tub 30 (shown in FIG. 1). During the wash fill, controller 80 closes first valve 74, and opens second and third valves 76, 78 to control water flowing through spray fill device 40 at a first flow rate which is greater than or equal to a flow rate of the rinse cycle to reduce the fill times associated with larger wash water volumes. Specifically, second valve 76 is configured to supply hot water to spray fill device 40. Third valve 78 is configured to supply cold water to spray fill device 40, and second and third valves 76, 78 may both be opened to supply warm water to spray fill device 40. The greater flow rate decreases the fill time for larger water volumes required for the wash cycle.

During the wash fill in the exemplary embodiment, second and third valves 76, 78 simultaneously supply water thus increasing the water pressure within body 42 as compared to water supplied by a single valve. When the water pressure exceeds a predetermined pressure, as described above, pressure relief mechanism 60 enables the water to flow through the corresponding outlet port 70. In the exemplary embodiment, when water flows through spray fill device 40 at the first flow rate, such as 5.66 gallons per minute, inner cap 62 slides to the second position to allow water flow through outlet port 70. As such, in the wash fill, spray fill device 40 channels water through outlet apertures 50 plus the additional outlet ports 70, which facilitates saving time for directing the predetermined amount of water into wash tub 30 (shown in FIG. 1), and avoids water splashing out of water tub 30 due to the undesirably high velocity of water channeling through outlet apertures 50. In an alternate embodiment, spray fill device 40 is not equipped with pressure relief mechanism 60, and spray fill device 40 channels water outward through outlet apertures 50, although it results in a high velocity in the wash fill.

During a rinse cycle, controller 80 closes second and third valves 76, 78, and opens first valve 74 to control water flowing through spray fill device 40 at a second flow rate. Alternatively, controller 80 only closes one of second and third valves 76, 78 such that the fill time is reduced. Water is then introduced through spray fill device 40 into wash tub 30 (shown in FIG. 1) to saturate the clothes that are received within basket 32 and spun after a wash cycle. Controller 80 also operates basket 32 to rotate when water is directed into tub 30 for saturating clothes within basket 32. Specifically, the first flow rate of water flowing through spray fill device 40 is limited to less than 2 gallons per minute. Basket 32 is rotated at a speed less than 80 revolutions per minute and less than 4 gallons of water is used in a single rinse cycle. More specifically, the second flow rate is controlled at approximately 1.5 gallons per minute, basket 32 is rotated at a speed of approximately 35 revolutions per minute, and approximately 3 gallons of water is used in a single rinse cycle. It is contemplated, however, that the second flow rate of water through spray fill device 40, and the rotating speed of basket 32, may be varied in alternative embodiments.

During the rinse cycle in the exemplary embodiment, the water pressure within channel 48 is below the predetermined pressure, such that inner cap 62 is positioned at the first position, and water is prohibited from flowing through outlet port 70. Spray fill device 40 then only channels water through the plurality of outlet apertures 50 into wash tub 30 (shown in FIG. 1), and to a location within a space approximately 10 inches upward from the bottom wall of basket 32 and approximately 4 inches inward from the sidewall of basket 32.

The methods and apparatus described herein facilitate rinsing clothes using less water than required in the washing machine. Specially, in the rinse cycle, the spray fill device channels water at a relatively low flow rate, which facilitates providing cleaner clothes while also substantially reducing quantity of water consumed to clean such clothes compared to known washing machines. The spray nozzle can be used to provide a plurality of rinses or a single rinse cycle. Additionally, the apparatus described herein facilitates avoiding a recirculating rinse water configuration, and a considerable amount of additional materials and assemblies are not utilized, such that the present invention obtains a good rinsability with low water consumption and lower manufacturing cost.

While the invention has been described in terms of various specific embodiments, those skilled in the art will recognize that the invention can be practiced with modification within the spirit and scope of the claims.

What is claimed is:

1. A spray fill device for delivering water to a washing machine, said spray fill device comprising:

a body defining an inlet, an outlet port, a mounting port, and a plurality of outlet apertures in flow communication with said inlet;

a first valve coupled to said inlet, said first valve configured to control a flow rate of water into said inlet; and a pressure relief mechanism coupled to said mounting port, in a first position said pressure relief mechanism inhibiting flow through said outlet port such that water flows through said plurality of outlet apertures when a pressure within said body is less than a predetermined pressure, and in a second position said pressure relief mechanism permitting water flow through said outlet port and said plurality of outlet apertures when said pressure within said body is at least equal to said predetermined pressure.

2. A spray fill device in accordance with claim 1 further comprising a second valve and a third valve coupled to said inlet, said second and third valves configured to supply a greater flow rate of water to said inlet during a wash fill than the flow rate of water through said first valve.

3. A spray fill device in accordance with claim 2 wherein said first, second, and third valves configured to deliver water at a first flow rate in a wash cycle and a second flow rate in a rinse cycle, said first flow rate greater than said second flow rate.

4. A spray fill device in accordance with claim 1 wherein said body comprises a cap positioned adjacent said mounting port and configured to cover said mounting port.

5. A spray fill device in accordance with claim 1 wherein said pressure relief mechanism comprises a member in flow communication with said mounting port, said member movable from a first position wherein flow through said outlet port is inhibited and a second position wherein flow through said outlet port is enabled.

6. A spray fill device in accordance with claim 5 wherein said pressure relief mechanism comprises a biasing member configured to bias said member toward said first position.

7. A spray fill device in accordance with claim 5 wherein said member is movable from said first position to said second position in response to a pressure within said body.

8. A spray fill device in accordance with claim 1 wherein flow through said outlet port is enabled during a wash fill.

9. A spray fill device in accordance with claim 1 wherein flow through said outlet port is inhibited during a rinse cycle.

10. A spray fill device in accordance with claim 1 wherein said body defines an elongated channel having first and second opposite ends, said first end including a first outlet port and a first pressure relief mechanism and said second end including a second outlet port and a second pressure relief mechanism, said plurality of outlet apertures arranged in rows between said first and second ends.

11. A spray fill device in accordance with claim 1 wherein said plurality of outlet apertures are formed at angles through said body from sixty to ninety degrees with respect to a horizontal plane when said spray fill device is mounted in the washing machine.

12. A washing machine comprising:

a cabinet;

a tub positioned within said cabinet;

basket rotatably mounted within said tub; and a spray fill device mounted within said cabinet and positioned to introduce water into said basket at a controlled flow rate, said spray fill device comprising:

a body defining an inlet, an outlet port, a mounting port, and a plurality of outlet apertures in flow communication with said inlet;

a first valve coupled to said inlet, said valve configured to control a flow rate of water into said inlet; and a pressure relief mechanism coupled to said mounting port, in a first position said pressure relief mechanism inhibiting flow through said outlet port such that water flows through said plurality of outlet apertures when a pressure within said body is less than a predetermined pressure, and in a second position said pressure relief mechanism permitting water flow through said outlet port and said plurality of outlet apertures when said pressure within said body is at least equal to said predetermined pressure.

13. A washing machine in accordance with claim 12 wherein said pressure relief mechanism is activated by water within said spray fill device, said pressure relief mechanism configured to increase a flow rate through said spray fill device during a wash fill.

14. A washing machine in accordance with claim 12 further comprising:

a second valve and a third valve coupled to said spray fill device; and a controller operatively coupled to said first, second, and third valves and configured to control said first, second, and third valves based on steps in a wash cycle.

15. A washing machine in accordance with claim 14 wherein said controller configured to activate said first valve during a rinse cycle and said second and third valves during a wash fill.

16. A washing machine in accordance with claim 12 wherein said spray fill device is configured to deliver water at a first flow rate during a wash cycle and a second flow rate during a rinse cycle, said first flow rate greater than said second flow rate.

17. A washing machine in accordance with claim 16 wherein said controller configured to rotate said basket at a rate of less than eighty revolutions per minute when said spray fill device delivers water at the first flow rate.

18. A spray fill device for delivering water to a washing machine, said spray fill device comprising:

body defining an inlet, an elongated channel having a first end and an opposing second end, each of said first end and said second end defining a respective outlet port and a respective mounting port, said elongated channel further defining a plurality of outlet apertures in flow communication with said inlet, said plurality of outlet apertures arranged in rows between said first end and said second end;

a valve coupled to said inlet, said valve configured to control a flow rate of water into said inlet; and a pressure relief mechanism positioned at each of said first end and said second end, each pressure relief mechanism coupled with respect to said respective mounting port, said pressure relief mechanism inhibiting flow through said respective outlet port when a pressure within said body is less than a predetermined pressure.

* * * * *